US011560767B1

(12) United States Patent
Phillips et al.

(10) Patent No.: US 11,560,767 B1
(45) Date of Patent: Jan. 24, 2023

(54) SINGLE RUN PRELOADED CASING HANGER AND ANNULUS SEAL ASSEMBLY AND METHODS OF USE THEREOF

(71) Applicant: FMC Technologies, Inc., Houston, TX (US)

(72) Inventors: Ryan William Phillips, Houston, TX (US); Justin Rodriguez, Houston, TX (US); Jasmeet S. Johar, Houston, TX (US); David Mcvay, Houston, TX (US); Marlon Arboleda, Houston, TX (US); Joseph Graham, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 17/380,848

(22) Filed: Jul. 20, 2021

(51) Int. Cl.
*E21B 33/04* (2006.01)
*E21B 33/06* (2006.01)

(52) U.S. Cl.
CPC ..... *E21B 33/04* (2013.01); *E21B 33/06* (2013.01)

(58) Field of Classification Search
CPC ..... E21B 33/04
See application file for complete search history.

(56) References Cited

U.S. PATENT DOCUMENTS 3,897,823 A 8/1975 Ahlstone
5,069,288 A 12/1991 Singeetham
7,096,956 B2 * 8/2006 Reimert ..... E21B 23/04 166/348
2010/0326664 A1 12/2010 Neto et al.
2013/0206427 A1 * 8/2013 Reimert ..... E21B 33/04 166/387
2014/0251630 A1 9/2014 Reimert et al.
2021/0010340 A1 1/2021 Queiroz et al.

FOREIGN PATENT DOCUMENTS

GB 2218444 A 11/1989
WO 2012018469 A1 2/2012

OTHER PUBLICATIONS

International Search Report issued in International Application No. PCT/US2022/037617 dated Oct. 21, 2022 (6 pages).
Written Opinion issued in International Application No. PCT/US2022/037617 dated Oct. 21, 2022 (10 pages).

* cited by examiner

*Primary Examiner* — Giovanna Wright
(74) *Attorney, Agent, or Firm* — Osha Bergman Watanabe & Burton LLP

(57) ABSTRACT

A running tool having an annulus seal assembly and casing hanger attached thereto may be sent into to the wellhead to lock and preload the casing hanger in a single trip. The running tool may be rotated a first time to drop the annulus seal assembly on the casing hanger, a first pressure may be applied axially above the annulus seal assembly to set the annulus seal assembly, the running tool may be rotated a second time to close a gap between the annulus seal assembly and the wellhead, and a second pressure may be applied axially above the annulus seal assembly to preload the casing hanger.

19 Claims, 10 Drawing Sheets

SINGLE RUN PRELOADED CASING HANGER AND ANNULUS SEAL ASSEMBLY AND METHODS OF USE THEREOF

BACKGROUND

A casing hanger is a component used in the completion of oil and gas production wells. The casing hanger is set in the tree or the wellhead and suspends casing within the well. In well operations, the casing hanger is often necessary to provide means for supporting a casing string within a wellhead or other wellhead component. Casing hangers generally include an outer body hanger and inner body hanger, where casing hangers function by locking the outer hanger body in place to the tree or wellhead and allowing a casing string to hang from the inner hanger body.

A landing string and landing tool may be used for lowering and locking the casing hanger. A subsea annulus seal assembly may be used to seal the annulus between the casing hanger and the wellhead. However, cyclical movement of the annulus seal assembly may prevent proper sealing.

The casing hanger allows a casing string to be lowered into a wellbore below a tubing head in a wellhead and latched downhole. To lock the casing hanger, a dedicated trip is required to install a casing hanger lockdown bushing for all producer wells. This may prevent continued cyclic movement of a subsea annulus seal assembly. It also ensures the tubing string is not exposed to the buckling that can occur with conventional tubing hanger applications. Alternatively, a rigidizing nut from completion equipment may be used to prevent this cyclic movement of the subsea annulus seal assembly. However, the rigidizing nut complicates the installation of the completion equipment because the rigidizing nut is installed by running it on drill pipe to torque the rigidizing nut and rigidize the casing hanger.

Prior proposed casing hanger and landing systems having included a variety of constructions for supporting a casing string and for effecting a seal between the casing hanger and the wellhead. In such prior systems, locking the casing hanger in the wellhead required either difficult mechanical manipulation of the landing tool or auxiliary hydraulic actuation systems. Such prior proposed systems were complex, were time-consuming, and in some instances, were likely to create additional problems. For example, during manipulation of the landing tool and string to achieve locking, parts of the landing system might be detached during rotation of the landing tool and landing string.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a method of installing a casing hanger in a wellhead. The method may include lowering a tool assembly into a wellhead. The tool assembly includes a running tool with a casing hanger and an annulus seal assembly removably attached thereon. The method may also include landing the casing hanger into the wellhead; landing the annulus seal assembly on the casing hanger; and locking the casing hanger and the annulus seal assembly within the wellhead. The method may further include preloading the casing hanger within the wellhead and raising the running tool out of the wellhead after completion of the preloading. The lowering, landing, locking, and preloading steps are completed in a single trip of the running tool being lowered to the wellhead and returned from out of the wellhead.

In another aspect, the embodiments disclosed herein relate to a method. The method may include locking down and preloading a casing hanger in a wellhead in a single trip. The single trip may include sending a running tool having an annulus seal assembly and casing hanger attached thereto into to the wellhead; rotating the running tool a first time to drop the annulus seal assembly on the casing hanger; applying a first pressure axially above the running tool to set the annulus seal assembly; rotating the running tool a second time to close a gap between the annulus seal assembly and the wellhead; and applying a second pressure axially above the annulus seal assembly to preload the casing hanger.

In yet another aspect, the embodiments disclosed herein relate to a tool assembly. The tool assembly may include a running tool that includes an outer body; an inner mandrel positioned within the outer body; an energizing mandrel slidably held between the inner mandrel and the outer body via a threaded connection between the inner mandrel and the energizing mandrel; a first anti-rotation device positioned between the outer body and the energizing mandrel, wherein when the first anti-rotation device is engaged, the energizing mandrel and the outer body are connected together, and wherein when the first anti-rotation device is disengaged, the outer body is independently rotatable with respect to the energizing mandrel; and a second anti-rotation device positioned between the inner mandrel and the outer body, wherein when the second anti-rotation device is engaged, the second anti-rotation device connects the inner mandrel to the outer body, and when the second anti-rotation device is disengaged, the inner mandrel is independently rotatable relative to the outer body. The tool assembly may also include a casing hanger operationally coupled to the running tool. The tool assembly may further include an annulus seal assembly operationally coupled to the running tool above the casing hanger. The annulus seal assembly may include a lower seal body coupled to an upper seal body via threads; a sealing element coupled to the lower seal body; and an external locking device positioned around an outer surface of the annulus seal assembly and axially between the upper seal body and an upper locking mandrel. Additionally, a third anti-rotation device is positioned between the outer body of the running tool and the upper locking mandrel of the annulus seal assembly, wherein when the third anti-rotation device is engaged, the outer body and the upper locking mandrel are connected, and when the third anti-rotation device is disengaged, the upper locking mandrel and outer body are independently rotatable from each other.

Other aspects and advantages will be apparent from the following description and the appended claims.

BRIEF DESCRIPTION OF DRAWINGS

The following is a description of the figures in the accompanying drawings. In the drawings, identical reference numbers identify similar or the same elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

In the following detailed description, certain specific details are set forth to provide a thorough understanding of various disclosed implementations and embodiments. However, one skilled in the relevant art will recognize that implementations and embodiments may be practiced without one or more of these specific details, or with other methods, components, materials, and so forth. As used herein, the term "coupled" or "connected" or "attached" may indicate establishing either a direct or indirect connection, and is not limited to either unless expressly referenced as such. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure.

Embodiments disclosed herein generally relate to an assembly and method for casing hanger installation in subsea operations, where a casing hanger and an annulus seal assembly may be locked and preloaded in a single trip. The casing hanger may be used to hang a casing or a casing string within a well. A casing string may be made up of various tubulars connected end-to-end and hung within a well to line a wellbore. A running tool may be run downhole and manipulated according to methods disclosed herein to install, lock, and preload the casing hanger and an annulus seal assembly within a wellhead.

Figure 1:
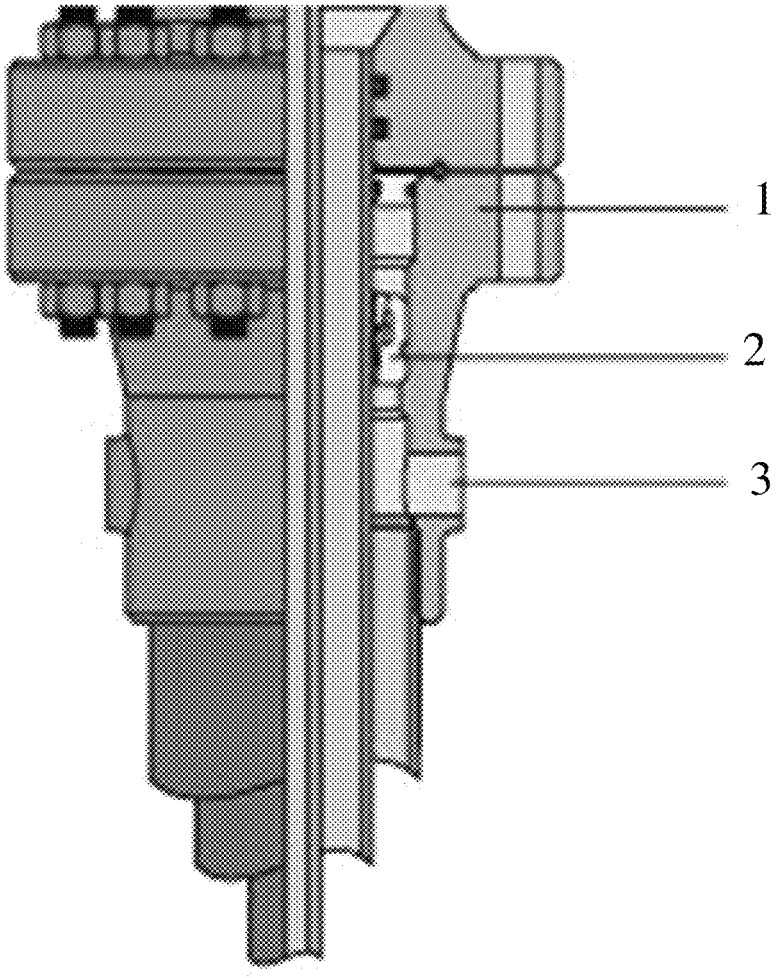
FIG. 1 (PRIOR ART)
FIG. 1 is a sectional view of a wellhead in accordance with one or more embodiments of the prior art.

Referring to FIG. 1, FIG. 1 illustrates a wellhead 1 in accordance with one or more embodiments of the prior art. Wellheads are well known in the art, and thus, a brief overview is given to help provide a general view the embodiments disclosed herein. The wellhead 1 includes a casing hanger 2 disposed on the wellhead 1. The casing hanger 2 provides a means of ensuring that a casing string is correctly located. Additionally, a sealing device or system may be incorporated with the casing hanger 2 to isolate a casing annulus from upper wellhead components (not shown). A port 3 may be provided in the wellhead 1 to access the casing annulus and perform various wellbore and annulus operations. Conventionally, multiple trips are required to install and preload the casing hanger 2 within the wellhead 1. For example, a plurality of trips is required to lockdown the casing hanger 2 into the wellhead. Additionally, a further trip with drill pipe is required to rigidize and preload the casing hanger 2. One with ordinary skill in the art would understand that FIG. 1 illustrates one example of a wellhead 1; however, the wellhead 1 may take any form (i.e., number of components, shape, or size) known in the art without departing from the scope of the present disclosure.

Methods of the present disclosure may be used to lock and preload a casing hanger in a wellhead in a single running tool trip to the wellhead, wherein the single trip may include landing an annulus seal assembly and the casing hanger in the wellhead using the running tool, rotating the running tool to move selected components of the running tool and annulus seal assembly, and applying pressure above the annulus seal assembly while the annulus seal assembly is landed on the casing hanger. Components of the running tool and annulus seal assembly may be selectively connected and disconnected while the annulus seal assembly is landed on the casing hanger, which may allow for the selected components to move axially up and down relative to the casing hanger while the running tool is rotated and pressure applied, and thereby lock and preload the casing hanger. For example, in a single trip to lock and preload a casing hanger in a wellhead, a running tool having an annulus seal assembly and casing hanger attached thereto may be sent into to the wellhead, the running tool may be rotated a first time to drop the annulus seal assembly on the casing hanger, a first pressure may be applied axially above the annulus seal assembly to set the annulus seal assembly, the running tool may be rotated a second time to close a gap between the annulus seal assembly and the wellhead, and a second pressure may be applied axially above the annulus seal assembly to preload the casing hanger.

Additionally, tool assemblies are disclosed herein that may be used to lock and preload a casing hanger in a subsea wellhead in a single trip of a running tool to the subsea wellhead. For example, tool assemblies according to embodiments of the present disclosure may include an annulus seal assembly connected to a running tool via a plurality of locking components, some of which may include anti-rotation devices, shearable elements, and others. Further, a casing hanger may be connected to the running tool below the annulus seal assembly. Once the tool assembly is sent to a subsea wellhead, the running tool may be rotated and selected locking components may be engaged and disengaged to lock and preload the casing hanger in a wellhead with the annulus seal assembly.

Figure 2:
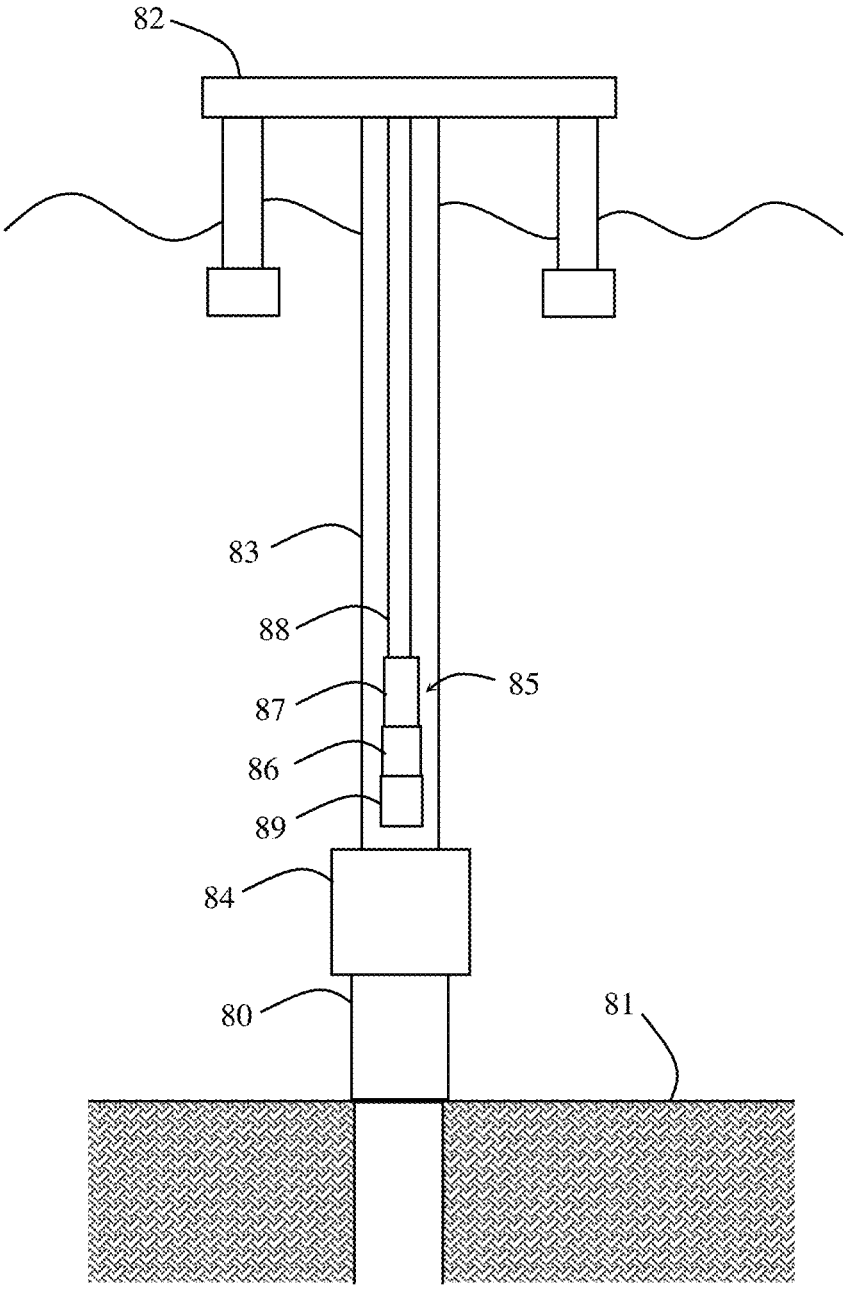
FIG. 2 shows a subsea system in accordance with embodiments of the present disclosure.

Embodiments of the present disclosure may be used in subsea systems, where a wellhead may be provided at the sea floor. For example, as shown in FIG. 2, a wellhead 80 to a well may be provided on the sea floor 81 and accessible from an offshore rig 82 (e.g., an offshore platform or boat) via a riser 83. A blowout preventer 84 or other well safety and pressure control apparatuses may be assembled over the wellhead 80. A tool assembly 85 according to embodiments of the present disclosure having an annulus seal assembly 86 and a casing hanger 89 attached at a lower end of a running tool 87 may be sent through the riser 83, the blowout preventer 84, and any other wellhead stack apparatus, to be inserted into the wellhead 80. The casing hanger 89 may be may be connected at the lowermost end of the running tool 87, and the annulus seal assembly 86 may be connected to the running tool 87 above the casing hanger 89, such that when the tool assembly 85 is sent into the wellhead 80, the casing hanger 89 may be positioned inside the wellhead 80 and the annulus seal assembly may be landed on the casing hanger 89 in a single trip. The tool assembly 85 may be sent to the wellhead 80 by attaching the running tool 87 to a drill string 88, where the drill string 88 may be extended from the rig 82 until the tool assembly 85 reaches inside the wellhead 80.

Figure 3:
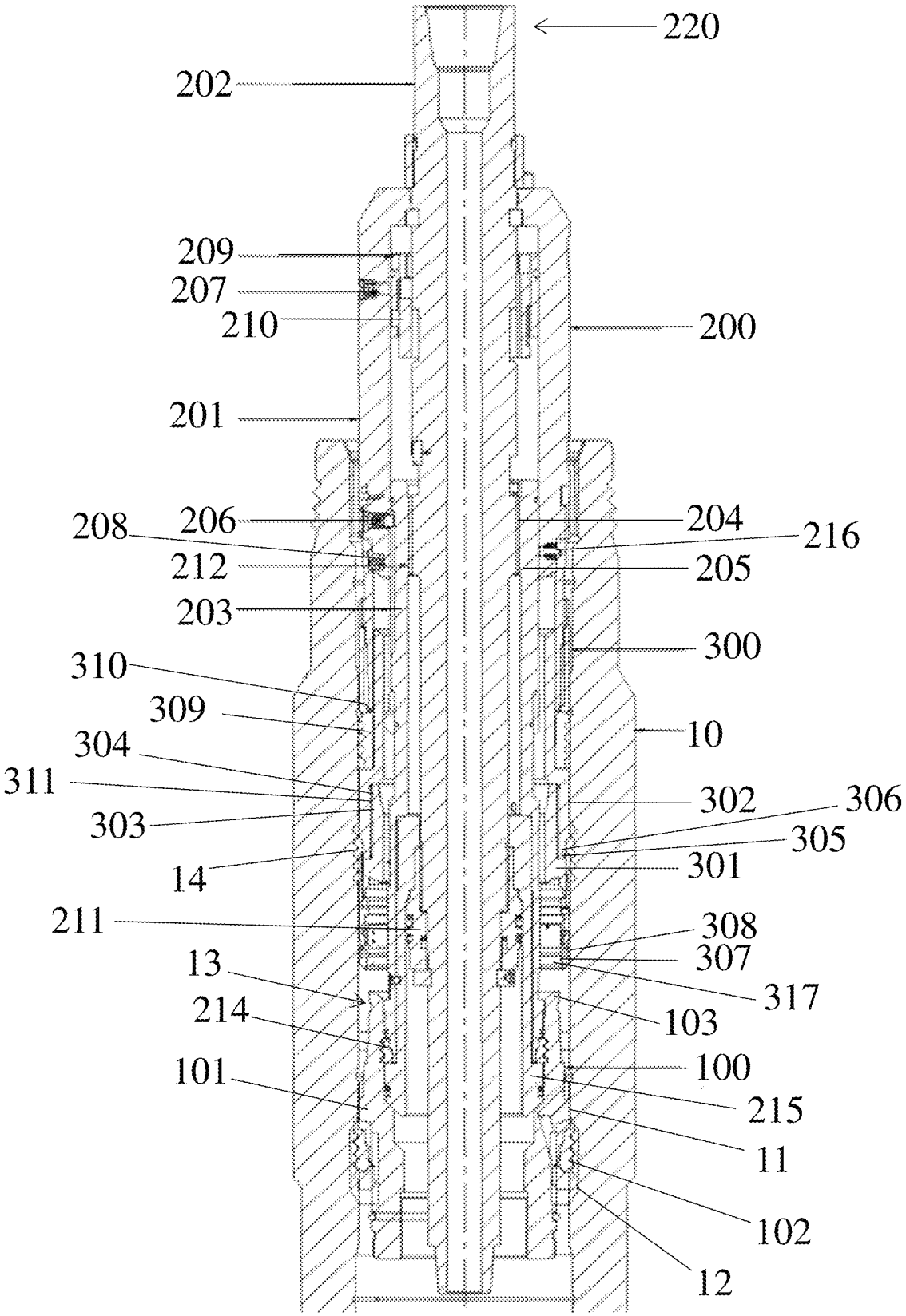
FIGS. 3-8 are cross-sectional views of a single trip installation and preload of an annulus seal assembly and a casing hanger assembly in accordance with one or more embodiments of the present disclosure.

Now referring to FIG. 3, in one or more embodiments, a casing hanger 100 assembled within a wellhead 10 in accordance with the present disclosure is illustrated. The casing hanger 100 includes a body 101 directly connected to the wellhead 10 by landing on an inner surface 11 of the wellhead 10. To land the casing hanger 100, a running tool 200 lowers the casing hanger 100 with an annulus seal assembly 300 into the wellhead. The casing hanger 100 is temporarily directly connected to the running tool 200 with a casing hanger locking device 214, such as a split lock ring, and run in a single trip with the annulus seal assembly 300 that is also temporarily directly connected to the running tool 200. In order to lock the body 101 of the casing hanger 100 on the wellhead 10, a first external locking device 102, such as a split lock ring, may expand from the body 101 into a first groove 12 of the wellhead 10. The first groove 12 may be machined, forged, cast, or formed by a manufacturing process known in the art. Furthermore, the first external locking device 102 may be attached to an outer surface of the body 101. One skilled in the art will appreciate how the first external locking device 102 may be made from metal or another material having sufficient strength, tensile strength, flexural strength and other properties needed to perform the support required with tension loading. Once the body 101 is locked, a downward axial movement of the casing hanger 100 may be hindered by first external locking device 102.

In some embodiments, an upper end 103 of the body 101 may be spaced a distance from the inner surface 11 of the wellhead 10 forming an annulus 13 between the casing hanger 100 and the wellhead 10. To seal this annulus 13 and lock the casing hanger 100 to the wellhead, a tool assembly according to embodiments of the present disclosure including a running tool 200 and an annulus seal assembly 300 may be sent into the wellhead 10 to install the annulus seal assembly 300 around the casing hanger 100 and in the wellhead 10 in a single trip. The tool assembly may be sent to the wellhead 10 by attaching the running tool 200 to a drill string (not shown) at a connection end 220 of the running tool 200. The drill string may be elongated by adding connections of drill pipe (where the drill string is formed of drill pipe connected together in an end-to-end fashion) to lower the attached running tool 200 to a subsea wellhead 10.

In one or more embodiments, the running tool 200 may include an outer body 201, an inner mandrel 202, and an energizing mandrel 203. The outer body 201 may surround a portion of the inner mandrel 202 and the energizing mandrel 203, where the inner mandrel 202 and the energizing mandrel 203 may extend axially downward from the outer body 201. The energizing mandrel 203 may be slidably held between the inner mandrel 202 and the outer body 201, such that when not mechanically prevented, the energizing mandrel 203 may axially slide between and along the inner mandrel 202 and outer body 201. Thus, the inner mandrel 202 may have an outer diameter smaller than an inner diameter of the energizing mandrel 203, and the energizing mandrel 203 may have an outer diameter smaller than an inner diameter of the outer body 201. Additionally, the running tool 200 may include an inner body 215 which is slidably held between the inner mandrel 202 and the energizing mandrel 203. The inner body 215 may be axially held to the inner mandrel 202 with a threaded piston 211.

The inner mandrel 202 includes an outer surface 204 in contact with an inner surface 205 of the energizing mandrel 203. Additionally, the outer surface 204 of the inner mandrel 202 and the inner surface 205 of the energizing mandrel 203 may interface at a threaded connection 212. When the threaded connection 212 is made up, all the components of the running tool 200 are constrained axially. When the inner mandrel 202 is rotated opposite the direction of the threads 212 (e.g., in a direction of uncoupling the threaded connection), the inner mandrel 202 and the energizing mandrel 203 may rotate with respect to each other, and when the threaded connection 212 is disengaged, the inner mandrel 202, outer body 201, and the threaded piston 211 may travel axially downward. When the inner mandrel 202 is rotated in the same direction of the threads 212 (e.g., in a direction of tightening the threaded connection), the energizing mandrel 203 is anti-rotated with the inner mandrel 202.

Further, the running tool 200 may include a plurality of anti-rotation devices such as spring-loaded pins 206, 207, 208, 216, to connect different components of the tool assembly (e.g., components of the running tool such as the inner mandrel 202, the energizing mandrel 203, and components of the annulus seal assembly 300). When components are connected via an anti-rotation device, the connected components may be rotated together, and when the anti-rotation device is disengaged, the components may be rotated relative to each other. While it is noted that four spring-loaded pins 206, 207, 208, 216 are shown, this is for example purposes only and any a number of spring-loaded pins may be used without departing from the scope of the present disclosure. Furthermore, the outer body 201 may include a stop 209 and a ring 210 to limit a rotation of the inner mandrel 202. In addition, the running tool 200 may include the threaded piston 211 around the inner mandrel 202 to receive axial pressure from a blowout preventer (see 84 in FIG. 7) above the wellhead 10.

As shown in FIG. 3, in one or more embodiments, the annulus seal assembly 300 includes a lower seal body 301 operationally coupled to an upper seal body 302. For example, a first contact surface 303 of the lower seal body 301 may be coupled to a first contact surface 304 of the upper seal body 302 via threads 311. Further, the lower seal body 301 may include a second contact surface 305, such as a load shoulder, adjacent to the first contact surface 303 for a second contact surface 306 of the upper seal body 302 to land on.

In some embodiments, a seal element 317 of the annulus seal assembly 300 may include one or more sealing surfaces (307, 308) to seal against the upper end 103 of the casing hanger body 101 and the inner surface 11 of the wellhead 10 to seal the annulus 13. For example, a first sealing surface 307 of the seal element 317 may have a profile shaped to seal against the upper end 103 of the body 101 to form a metal-to-metal seal between the annulus seal assembly 300 and the casing hanger 100. Additionally, a second sealing surface 308 of the seal element 317 may have a profile shaped to seal against the inner surface 11 of the wellhead 10 to form a metal-to-metal seal between the annulus seal assembly 300 and the wellhead 10. It is further envisioned that an elastomer seal may be provided in place of the first sealing surface 307 and/or the second sealing surface 308.

In one or more embodiments, the annulus seal assembly 300 may be removably connected to the running tool 200 via the spring loaded pin 216 connecting an upper locking mandrel 310 of the annulus seal assembly 300 to the running tool 200. To lock the annulus seal assembly 300 in place, a second external locking device 309, such as a split lock ring, may be arranged to expand from the upper seal body 302 of the annulus seal assembly 300 into a second groove 14 of the wellhead 10. For example, the second external locking device 309 may be positioned axially between a landing shoulder of the upper seal body 302 and an upper locking mandrel 310 and radially between the upper seal body 302 and the wellhead 10. The second groove 14 in the wellhead 10 may be formed in an inner surface of the wellhead, axially above the first groove 12, and may be machined, forged, cast, or formed by a manufacturing process known in the art. One skilled in the art will appreciate how the second external locking device 309 may be made from metal or another material having sufficient strength, tensile strength, flexural strength and other properties needed to perform the support required with tension loading. Once the annulus seal assembly 300 is locked, the annulus 13 may be sealed. Furthermore, the annulus seal assembly 300 may be preloaded to attain better sealability of the annulus 13. Preloading the annulus seal assembly 300 may include applying an axial load to the annulus seal assembly 300 to remove excess play between the annulus seal assembly 300 and the wellhead 10.

Still referring to FIG. 3, the casing hanger 100 may be landed in the wellhead 10, via the running tool 200, and then cemented and packed off within the wellhead 10. With the casing hanger 100 installed on the wellhead 10, a tool assembly according to embodiments of the present disclosure including the running tool 200 may be operated to land and preload the annulus seal assembly 300 on the casing hanger 100. Initially, anti-rotation devices 206, 207 may be provided in an initial position to allow the inner mandrel 202 of the running tool 200 to rotate when sending the running tool 200 to the wellhead 10 without rotating the outer body 201, the energizing mandrel 203, or the connected annulus seal assembly 300. For example, a first spring-loaded pin 206 may be engaged between the energizing mandrel 203 and the outer body 201 to prevent the connected annulus seal assembly 300 from turning while rotations are applied to the inner mandrel 202 during operation of the running tool 200 (e.g., while sending the running tool 200 to the wellhead 10). Simultaneously, a second spring-loaded pin 207 may be disengaged from the stop 209, allowing the inner mandrel 202 of the running tool 200 to rotate freely from the outer body 201 of the running tool 200. Further, once the inner mandrel 202 of the running tool 200 is rotated a predetermined degree, the blowout preventer may be closed to provide axial downward pressure on the threaded piston 211 of the running tool 200 to axially lower the annulus seal assembly 300 toward the casing hanger 100.

Figure 4:
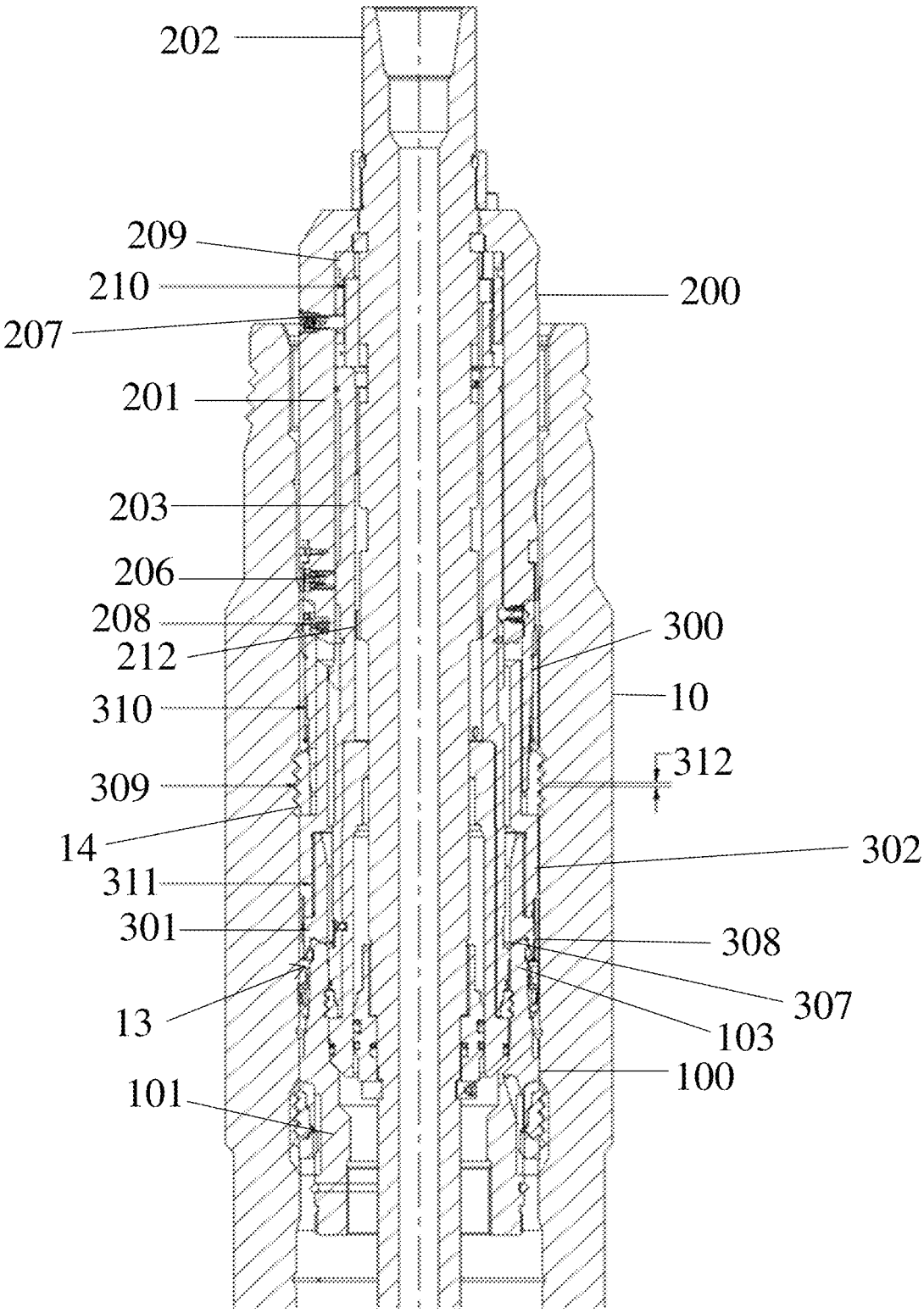

FIGS. 3 and 4 may represent the steps in a first rotation step according to methods of the present disclosure, which may include sending a running tool having an annulus seal assembly and casing hanger attached thereto into to the wellhead and rotating the running tool a first time to drop the annulus seal assembly on the casing hanger. For example, a first rotation step in methods disclosed herein may include lowering an annulus seal assembly 300 into the wellhead 10 using a running tool 200, wherein the annulus seal assembly 300 is attached to the outer body 201 of the running tool 200 via the energizing mandrel 203, wherein the first anti-rotation device 206 between the energizing mandrel 203 and the outer body 201 is engaged to prevent the annulus seal assembly 300 from rotating while the inner mandrel 202 rotates, and wherein the second spring-loaded pin 207 between the inner mandrel 202 and the outer body 201 is disengaged to allow the inner mandrel 202 to rotate without rotating the outer body 201. When the annulus seal assembly 300 is lowered into the wellhead 10, the inner mandrel 202 of the running tool 200 may be rotated until the inner mandrel 202 disengages with the energizing mandrel 203 to land the annulus seal assembly 300 onto the casing hanger 100.

As shown in FIG. 4, after the annulus seal assembly 300 is landed on the casing hanger 100, a first pressure from the blowout preventer may be applied above the running tool 200 to create an axial force downward to lock and preload the annulus seal assembly 300 to the casing hanger 100. The threads 212 between the energizing mandrel 203 and the inner mandrel 202 may disengage after a predefined number of rotations are applied to the inner mandrel 202, allowing the running tool 200 to land the annulus seal assembly 300 onto the casing hanger 100. Further, the first sealing surface 307 of the seal element 317 of the annulus seal assembly 300 may be landed over the upper end 103 of the casing hanger body 101, while the second sealing surface 308 of the seal element 317 of the annulus seal assembly 300 may be pressed against the inner surface 11 of the wellhead 10 to seal the annulus 13. As the axial force downward is applied, the second external locking device 309 may be forced, by the upper locking mandrel 310, radially outward into the second groove 14 of the wellhead 10. When the second external locking device 309 is pushed into the second groove 14, a portion of the second external locking device 309 may be positioned in the second groove 14, and another portion of the second external locking device 309 may extend into the upper seal body 302 of the annulus seal assembly 300, such that the second external locking device 309 may prevent the upper seal body 302 from moving axially upward. In such manner, the second external locking device 309 may lock the annulus seal assembly 300 into the wellhead 10. Additionally, when landing the annulus seal assembly 300 on the casing hanger 100, the ring 210 in the running tool may be pressed upward by the energizing mandrel 203 until the ring 210 is stopped by the stop 209 in the running tool 200 to stop the upper locking mandrel 310 of the annulus seal assembly half-way into a stroking cycle.

In one or more embodiments, the second external locking device 309 may be offset by an axial gap 312 formed between the inner surface of the second groove 14 of the wellhead 10 and the outer surface of the second external locking device 309 in order to allow for tolerances and debris while landing and cementing the casing hanger 100. The inner surface of the second groove 14 of the wellhead 10 and the outer surface of the second external locking device 309 may have correspondingly shaped teeth (or grooves). When the second external locking device 309 is moved axially downward into the second groove 14 (e.g., by applying the first pressure using a blowout preventer positioned above the wellhead 10), the teeth may be axially misaligned, which forms the axial gap 312 between the teeth. In such arrangement, a portion of the teeth lower surfaces on the second external locking device 309 may contact a portion of the teeth upper surfaces in the second groove 14, and the axial gap 312 is formed between the teeth upper surfaces on the second external locking device 309 and the teeth lower surfaces in the second groove 14. The sloped surfaces of the corresponding teeth formed on the second external locking device 309 and the second groove 14 may allow for the second external locking device 309 to slide axially and radially relative to the second groove 14 during setting and preloading of the annulus seal assembly 300 on the casing hanger 100. Other corresponding geometries may be provided on the inner surface of the second groove 14 and the outer surface of the second external locking device 309 to allow for an axial gap 312 to be formed and closed using methods according to embodiments disclosed herein.

When the axial gap 312 is formed between the second external locking device 309 and the second groove 14, the first spring-loaded pin 206 may be disengaged between the energizing mandrel 203 and the outer body 201, thereby allowing the outer body 201 to rotate freely. The second spring-loaded pin 207 may be engaged between the outer body 201 and the stop 209, thereby locking the outer body 201 to the inner mandrel 202. Additionally, a third spring-loaded pin 208 between the outer body 201 and the upper locking mandrel 310 of the annulus seal assembly 300 may be engaged to allow the upper seal body 302 of the annulus seal assembly 300 to rotate with the outer body 201 of the running tool 200. With the first spring-loaded pin 206 disengaged, the second spring-loaded pin 207 engaged, and the third spring-loaded pin 208 engaged, additional rotations may be applied to the inner mandrel 202 in a second rotation step.

Still referring to FIG. 4, as additional rotations are applied, the upper seal body 302 may rotate up the threads 311 between the upper seal body 302 and the lower seal body 301, as the lower seal body 301 is anti-rotated to the casing hanger 100. For example, friction and high contact force or locking keys may keep the lower seal body 301 from rotating with respect to the casing hanger 100 as the upper seal body 302 is rotated up the threads 311. The axial upward movement of the upper seal body 302 may push the second external locking device 309 upward (e.g., via an interfacing landing shoulder between the upper seal body 302 and the second external locking device 309), where the second external locking device 309 may be moved upward relative to the second groove 14 to reduce or eliminate the axial gap 312 (See FIG. 4) between the second external locking device 309 and the second groove 14 of the wellhead 10.

As shown through FIGS. 4-7, after rotating the running tool 200 a first time to drop the annulus seal assembly 300 on the casing hanger 100 and applying a first pressure axially above the annulus seal assembly 300 to set the annulus seal assembly 300, methods according to embodiments of the present disclosure may also include rotating the running tool 200 a second time to close the axial gap 312 between the annulus seal assembly 300 and the wellhead 10. For example, according to embodiments of the present disclosure, methods may include rotating the inner mandrel 202 and connected outer body 201 and upper locking mandrel 310 to rotate the upper seal body 302 and move the upper seal body 302 axially upward, wherein as the upper seal body 302 moves axially upward, a portion of the upper seal body 302 may push the second external locking device 309 axially upward to engage with and lock into the wellhead 10.

Figure 5:
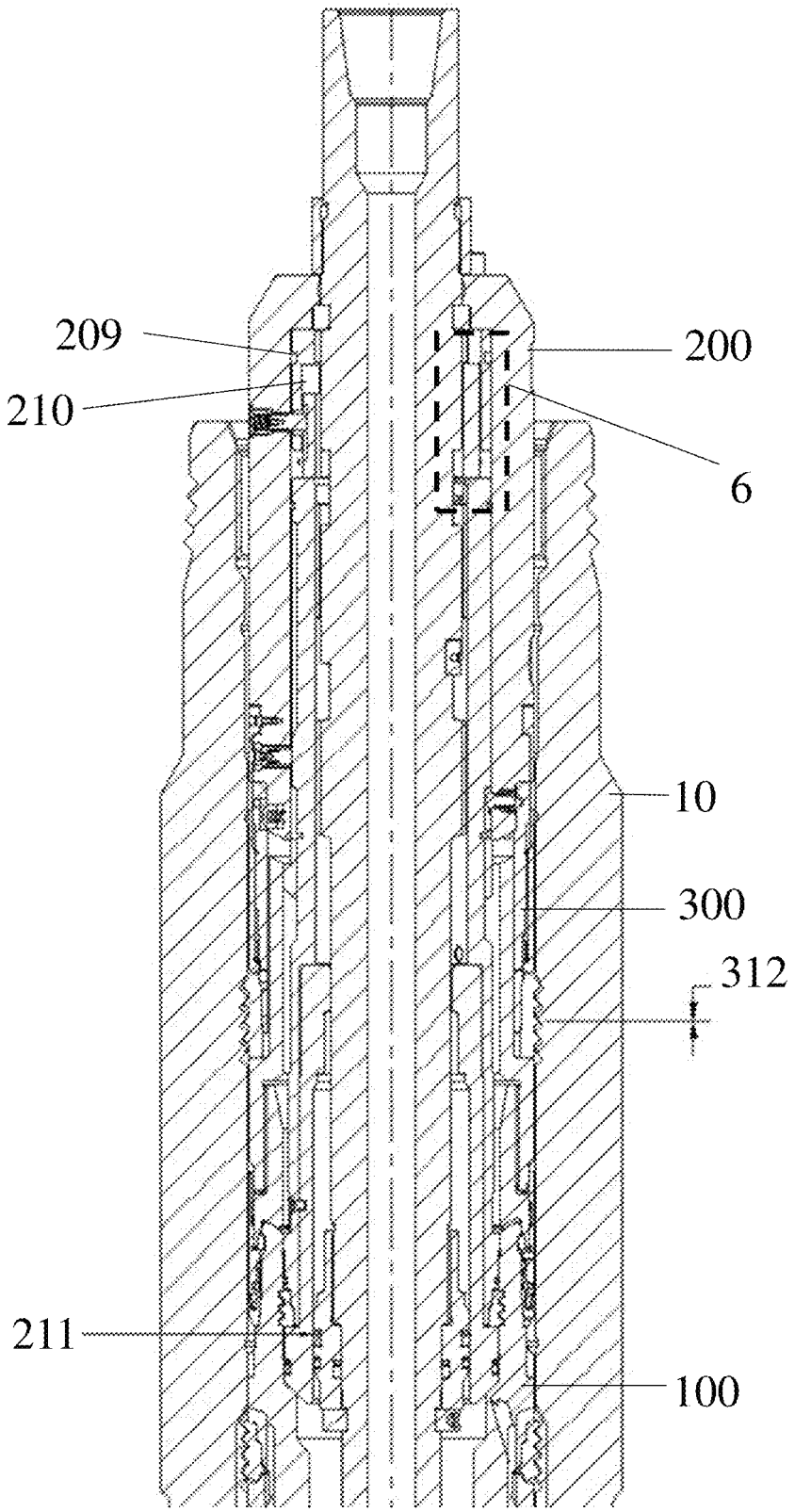
Figure 6:
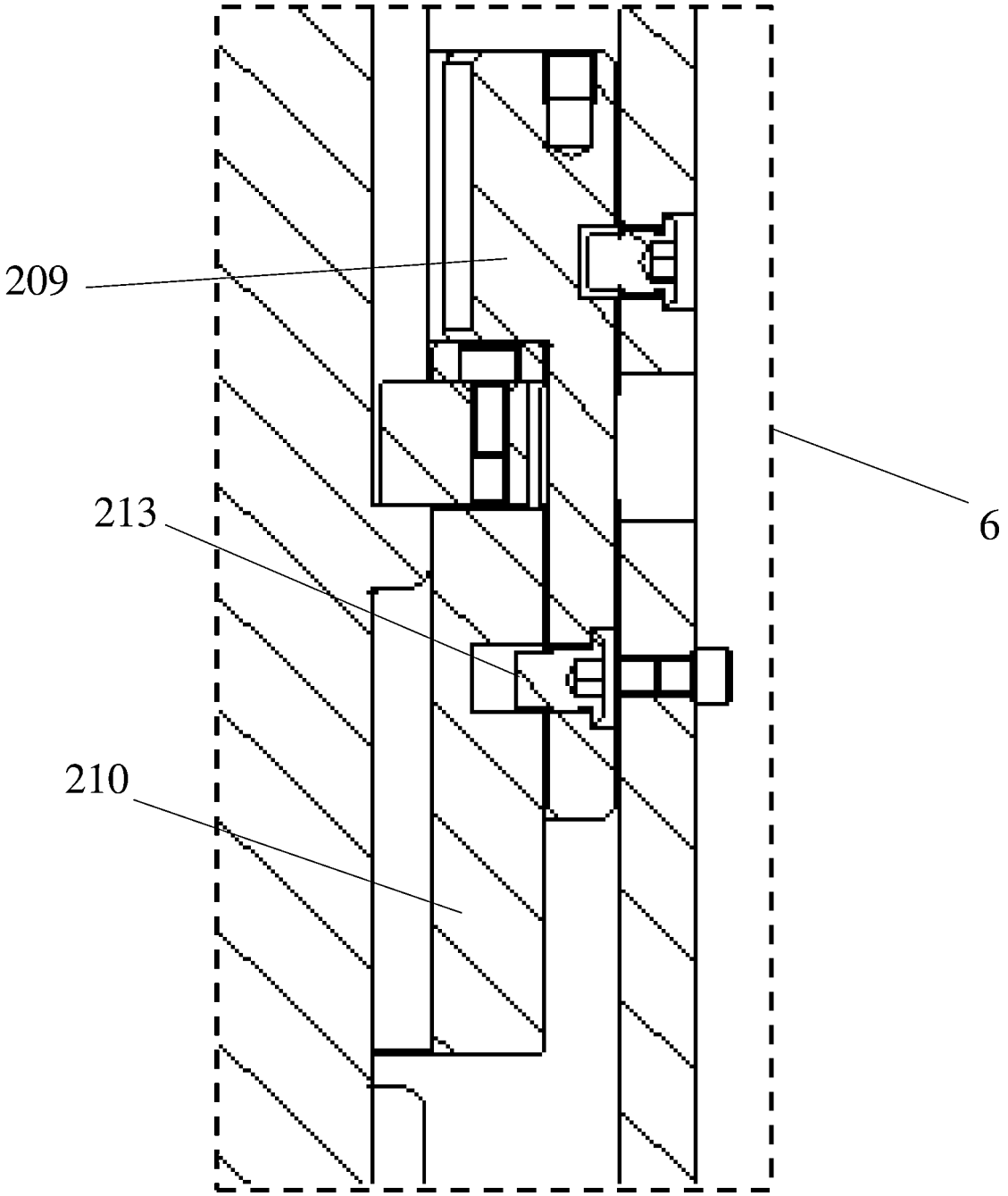

As shown in FIG. 5, the second rotation step may result in elimination of the axial gap 312 between the second external locking device 309 of the annulus seal assembly 300 and the wellhead 10 to eliminate the axial gap 312 and rigidize the annulus seal assembly 300 and the casing hanger 100 into the wellhead 10. FIG. 6 shows a zoomed in view of area 6 in FIG. 5. As shown in FIG. 6, with torque built up on the inner mandrel 202, shear pins 213 connecting the stop 209 and ring 210 may shear, allowing the stop 209 and ring 210 to rotate with respect to each other. Referring back to FIG. 5, after the stop 209 and ring 210 have rotated with respect to each other, the running tool 200 may stroke the upper locking mandrel 310 further with additional pressure to fully preload the annulus seal assembly 300 and the casing hanger 100 into the wellhead 10.

Figure 7:
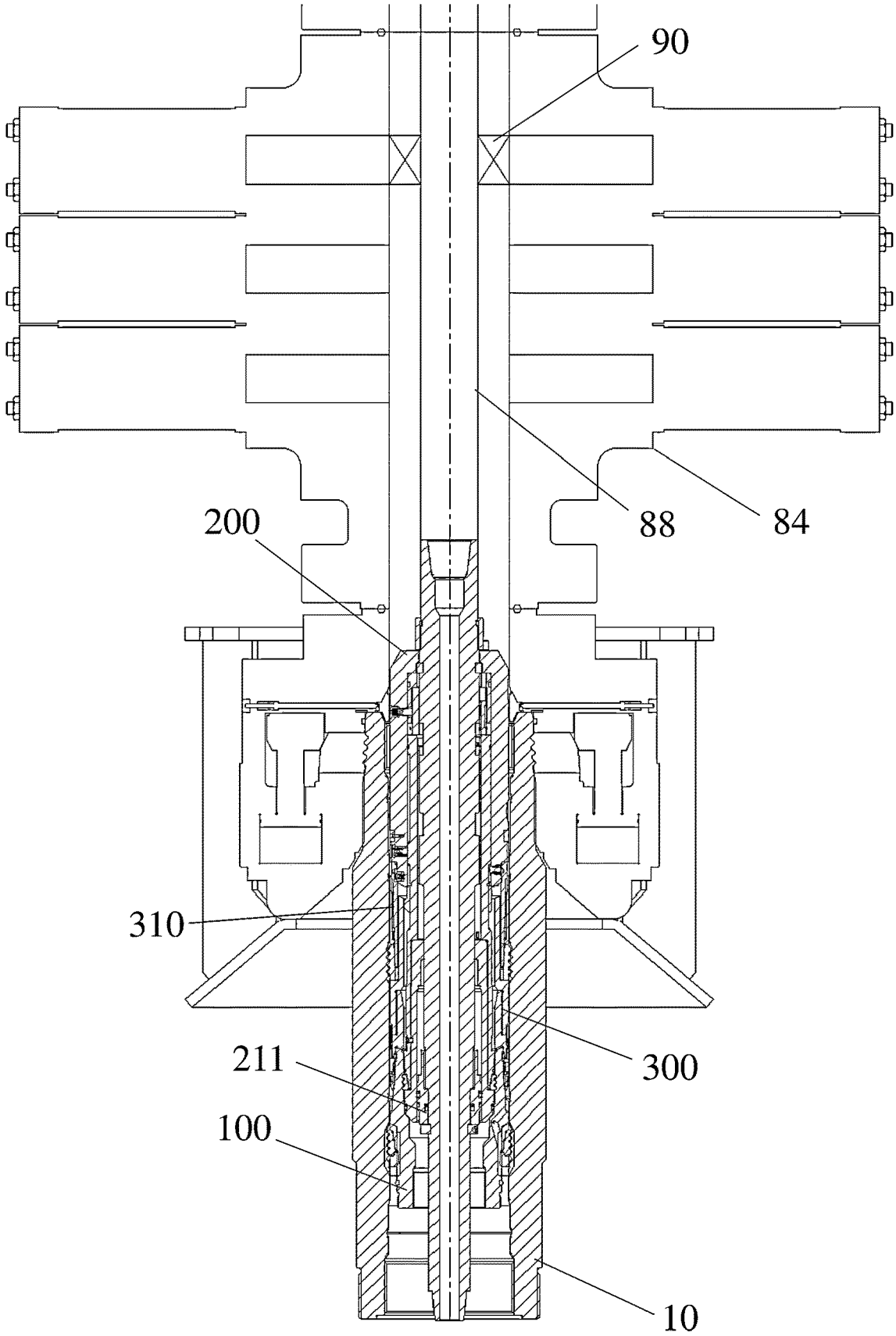

Now referring to FIG. 7, after performing the second rotation step, methods disclosed herein may also include applying a second pressure, via the blowout preventer 84, axially above the annulus seal assembly 300 to preload the annulus seal assembly 300 and casing hanger 100 into the wellhead 10. In some embodiments, the second pressure may be applied via the blowout preventer, above the running tool 200 to fully stroke the upper locking mandrel 310, thereby preloading the annulus seal assembly 300 and the casing hanger 100 into the wellhead 10. For example, applied pressure from the blowout preventer applied above the running tool 200 may create an axial load that pushes down on the threaded piston 211. The axial load may be formed using a seal 90 between the drill pipe 88 attached to the running tool 200 and the blowout preventer 84 that may seal around a drill pipe outer diameter.

Figure 8:
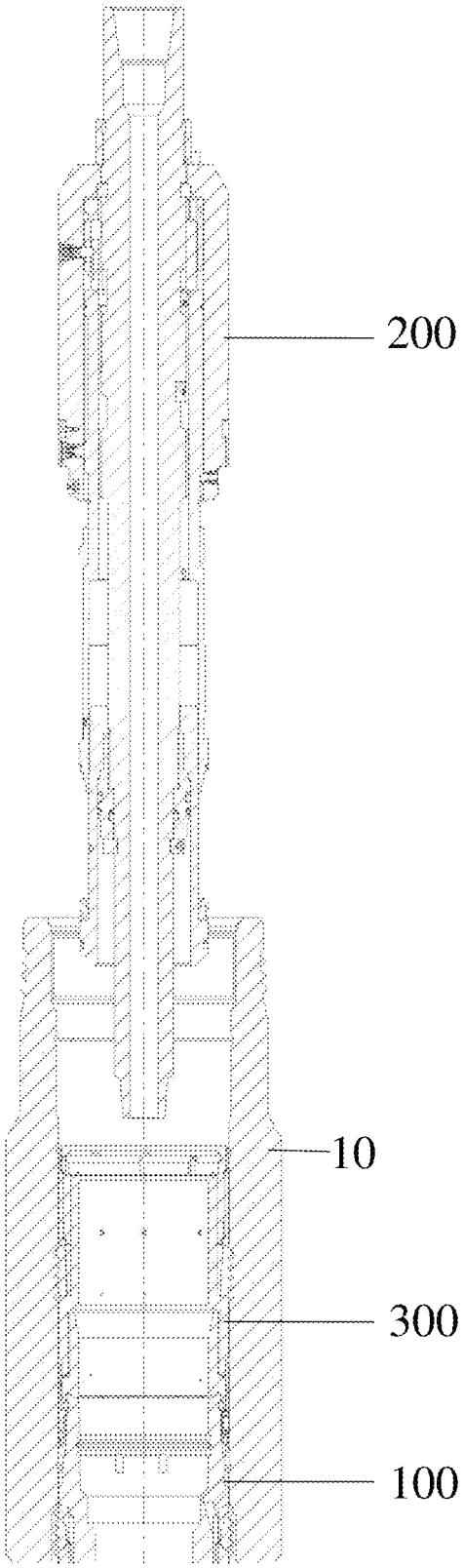

With the annulus seal assembly 300 and the casing hanger 100 fully preloaded, the running tool 200 may be retrieved and pulled out of the wellhead 10, as shown by FIG. 8, leaving the casing hanger 100 sealed and preloaded in the wellhead 10.

Figure 9:
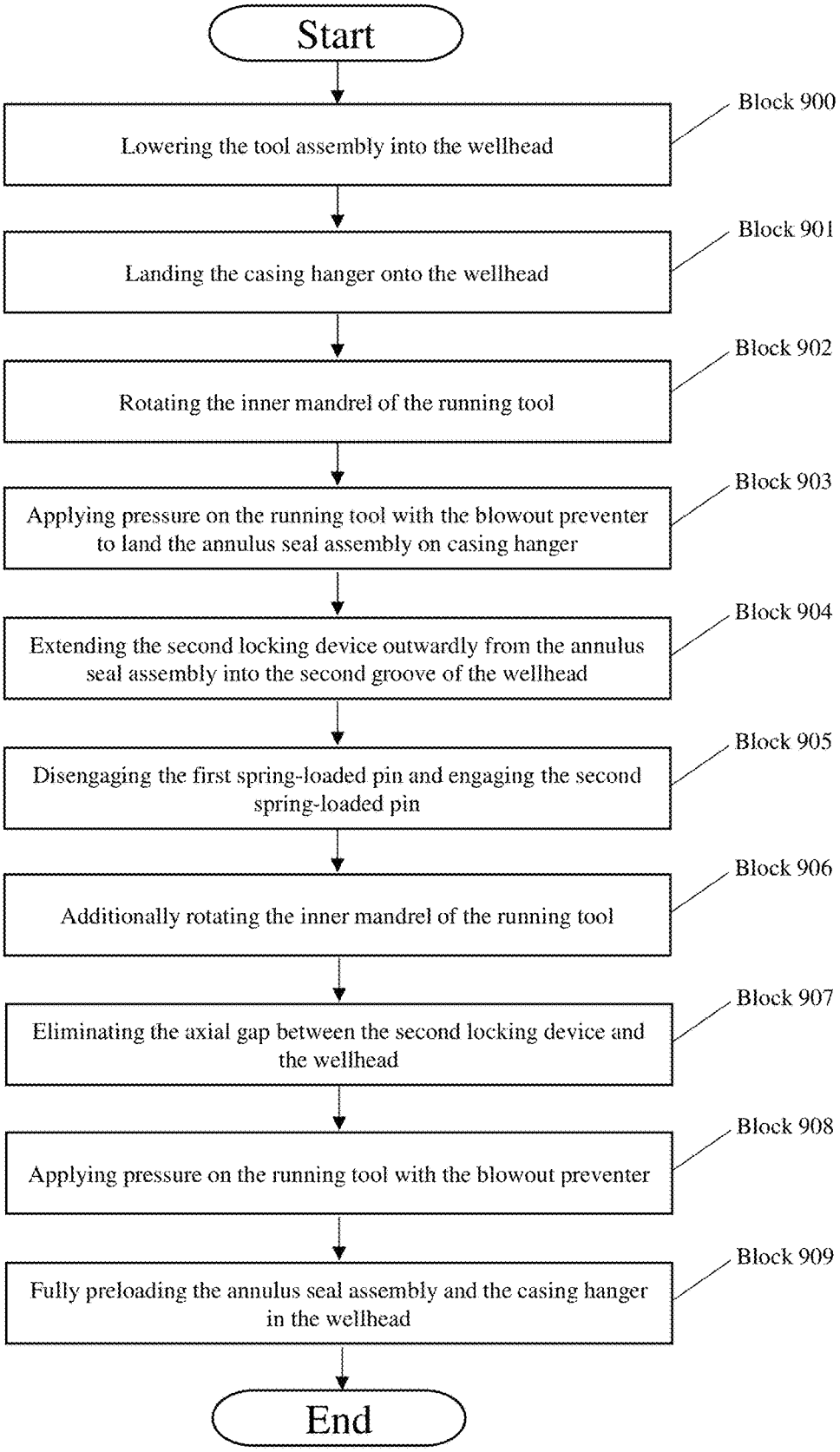
FIG. 9 is a flow chart of a method in accordance with embodiments disclosed herein.

FIG. 9 is a flowchart showing a method according to embodiments of the present disclosure of using a running tool (e.g., running tool 200 shown in FIGS. 3-8) to install and preload a casing hanger (e.g., casing hanger 100 shown in FIGS. 3-8) and an annulus seal assembly (e.g., annulus seal assembly 300) within a wellhead. One or more blocks in FIG. 9 may be performed by one or more components (e.g., a computing system coupled to a controller in communication with the running tool). For example, a non-transitory computer readable medium may store instructions on a memory coupled to a processor such that the instructions include functionality for operating the running tool. While the various blocks in FIG. 9 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

A shown in Block 900, the method includes lowering a tool assembly into the wellhead. The tool assembly may include a running tool, which may be attached at a connection end to a drill string. A casing hanger may be temporarily, directly connected to the running tool with a locking device, such as a split lock ring, and run in a single trip with an annulus seal assembly that is also temporarily directly connected to the running tool 200. The casing hanger may be attached at an axial end of the running tool opposite the drill string connection end, and the annulus seal assembly may be attached above the casing hanger. The tool assembly may be lowered into the wellhead such that the casing hanger is lowered into the wellhead first, and the annulus seal assembly is positioned proximate to or adjacent to the casing hanger in the wellhead. In Block 901, the casing hanger may be landed on an inner surface of the wellhead. A first external locking device may extend outwardly from the casing hanger into a first groove of the wellhead to hold the casing hanger axially in place in the wellhead.

After lowering the running tool into the wellhead, different components of the tool assembly may be connected together or disconnected to prepare for a first rotation step. In some embodiments, the different components may be connected/disconnected by activating one or more locking devices to engage or disengage with another component. Locking devices may be activated, for example, using pressure differentials, electronic signals, or mechanical activation, and may be activated from a surface location or upon reaching a condition in the wellhead. In some methods, after lower the running tool into the wellhead, an outer body of the running tool may be disconnected from an inner rotatable mandrel of the running tool (e.g., by disengaging a second spring-loaded pin from between the outer body and inner mandrel), an energizing mandrel of the running tool may be connected to the outer body (e.g., by engaging a first spring-loaded pin between the outer body and the energizing mandrel), and the outer body may be connected to the annulus seal assembly. Once the tool assembly has selected components connected and disconnected, the inner mandrel of the running tool may be rotated in a first rotation step, as shown in Block 902, which may axially move the annulus seal assembly downward. For example, threads between the inner mandrel and energizing mandrel of the running tool disengage and allow the outer body and inner mandrel of the running tool to lower the annulus seal assembly onto the casing hanger.

In Block 903, a blowout preventer positioned above the wellhead may be closed to apply pressure above the running tool and create an axial downward force to land the annulus seal assembly on the casing hanger. When the annulus seal assembly is landed and set on the casing hanger, a first seal surface of the annulus seal assembly may be set on an upper end of the casing hanger, and a second seal surface of the annulus seal assembly may seal against the inner surface of the wellhead.

In Block 904, a second external locking device may be extended outwardly from the annulus seal assembly into a second groove of the wellhead to lockdown the casing hanger within the wellhead. Furthermore, an axial gap may initially be formed between the second external locking device and the second groove of the wellhead to allow for tolerances and debris while landing and cementing the casing hanger.

In Block 905, the energizing mandrel of the running tool may be disconnected from the outer body (e.g., by disengaging the first spring-loaded pin between the outer body and the energizing mandrel), which may allow the outer body to rotate independently of the energizing mandrel. Additionally, in Block 605, the outer body may be connected to the inner mandrel, e.g., by engaging the second spring-loaded pin between the outer body and the rings to lock the outer body to the inner mandrel of the running tool.

In Block 906, when the inner mandrel is connected to the outer body, the inner mandrel may be rotated in a second rotation step, thereby also rotating the outer body of the running tool. Additionally, the outer body of the running tool may be connected to the upper locking mandrel of the annulus seal assembly (e.g., by engaging a third spring-loaded pin between the outer body and the upper locking mandrel) to allow the upper seal body of the annulus seal assembly to rotate. Further, the threads between the upper seal body and lower seal body of the annulus seal assembly may be configured in a selected handedness (e.g., left-handed threads) that allows the upper seal body to move axially upward relative to the lower seal body when the running tool is rotated during the second rotation step in a direction opposite from the rotation direction during the first rotation step. When the upper seal body is moved axially upward, the upper seal body may push the second external locking device upward within the second groove to eliminate the gap between the second external locking device and the second groove as shown in Block 907. With torque built on the inner mandrel, shear pins may shear, thereby allowing the rings in the running tool to rotate to further stroke the upper locking mandrel downward.

In Block 908, the blowout preventer may be used again to apply further pressure on the running tool. With the additional pressure from the blowout preventer, the upper locking mandrel may be fully stroked to preload the casing hanger in the wellhead. In Block 909, the annulus seal assembly and the casing hanger are fully preloaded on the wellhead, and the running tool may be pulled out and retrieved from the wellhead.

Figure 10:
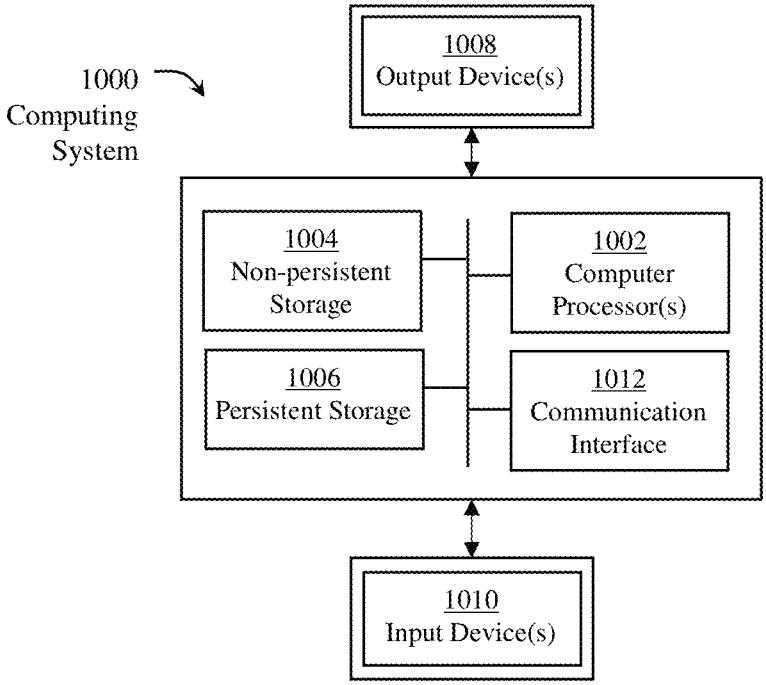
FIG. 10 is a schematic diagram of a computing system in accordance with embodiments disclosed herein.

Implementations herein for operating the running tool 200 to install and preload the casing hanger 100 and the annulus seal assembly 300 within the wellhead 10 may be implemented on a computing system coupled to a controller in communication with the various components of the running tool 200. Any combination of mobile, desktop, server, router, switch, embedded device, or other types of hardware may be used with the running tool 200. For example, as shown in FIG. 10, the computing system 1000 may include one or more computer processors 1002, non-persistent storage 1004 (e.g., volatile memory, such as random access memory (RAM), cache memory), persistent storage 1006 (e.g., a hard disk, an optical drive such as a compact disk (CD) drive or digital versatile disk (DVD) drive, a flash memory, etc.), a communication interface 1012 (e.g., Bluetooth interface, infrared interface, network interface, optical interface, etc.), and numerous other elements and functionalities. It is further envisioned that software instructions in a form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. For example, the software instructions may correspond to computer readable program code that, when executed by a processor(s), is configured to perform one or more embodiments of the disclosure.

The computing system 1000 may also include one or more input devices 1010, such as a touchscreen, keyboard, mouse, microphone, touchpad, electronic pen, or any other type of input device. Additionally, the computing system 1000 may include one or more output devices 1008, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 1002, non-persistent storage 1004, and persistent storage 1006. Many different types of computing systems exist, and the input and output device(s) may take other forms.

The computing system 1000 of FIG. 10 may include functionality to present raw and/or processed data, such as operational status of locking devices within the tool assembly. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model. For example, a GUI may first obtain a notification from a software application requesting that a particular data object be presented within the GUI. Next, the GUI may determine a data object type associated with the data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the data object and render a visual representation of the data values within a display device according to the designated rules for that data object type. Data may also be presented through various audio methods or through haptic methods (e.g., vibrations).

Methods of using a running tool, according to embodiments herein, to install and preload an annulus seal assembly and a casing hanger may be done in a single trip of the running tool to a subsea wellhead. Additionally, methods disclosed herein may eliminate the use of additional drill pipe trips to the subsea wellhead otherwise required to rigidize and preload the casing hanger. Locking down and preloading the annulus seal assembly and the casing hanger in a single trip may improve the reliability of the seal and safety of the offshore operations while reducing exposure of personnel to the hazards of handling and running additional equipment. Accordingly, one or more embodiments in the present disclosure may be used to overcome challenges as well as provide additional advantages over conventional methods of installing and preloading an annulus seal assembly and casing hanger, as will be apparent to one of ordinary skill. In one or more embodiments, methods and systems disclosed herein may be safer, faster, and lower in cost as compared with conventional methods due, in part, to being performed in only a single trip. Overall installing and preloading an annulus seal assembly and casing hanger with the single trip running tool may minimize product engineering, risk associated with handling and running additional equipment, reduction of assembly time, hardware cost reduction, and weight and envelope reduction.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A method of installing a casing hanger in a wellhead, comprising:

lowering a tool assembly into a wellhead, wherein the tool assembly comprises a running tool with a casing hanger and an annulus seal assembly removably attached thereon;

landing the casing hanger into the wellhead;

landing the annulus seal assembly on the casing hanger, wherein landing the annulus seal assembly on the casing hanger comprises:

engaging a first anti-rotation device of the running tool between an energizing mandrel of the running tool and an outer body of the running tool to prevent the annulus seal assembly from rotating;

disengaging a second anti-rotation device between an inner mandrel of the running tool and the outer body; and rotating the inner mandrel of the running tool until the inner mandrel disengages with the energizing mandrel to land the annulus seal assembly onto the casing hanger;

locking the casing hanger and the annulus seal assembly within the wellhead;

preloading the casing hanger within the wellhead; and raising the running tool out of the wellhead after completion of the preloading;

wherein the lowering, landing, locking, and preloading steps are completed in a single trip of the running tool being lowered to the wellhead and returned from out of the wellhead.

2. The method of claim 1, wherein locking the casing hanger and the annulus seal assembly comprises:

applying a first pressure above the annulus seal assembly to move an external locking device of the annulus seal assembly into an internal groove formed in the wellhead to lock the annulus seal assembly and the casing hanger in the wellhead.

3. The method of claim 2, further comprising moving an upper locking mandrel of the annulus seal assembly axially downward using the first pressure, wherein the axial downward movement of the upper locking mandrel pushes the external locking device of the annulus seal assembly radially outward into the internal groove formed in the wellhead to lock the annulus seal assembly and the casing hanger to the wellhead.

4. The method of claim 2, wherein an upper seal body is moved axially upward by rotating the inner mandrel until an axial gap between the external locking device and the internal groove is eliminated.

5. The method of claim 2, wherein preloading the casing hanger comprises:

stopping an upper locking mandrel in the annulus seal assembly half way through a stroking cycle;

disengaging the first anti-rotation device;

engaging the second anti-rotation device to lock the inner mandrel to the outer body;

engaging a third anti-rotation device to lock an upper locking mandrel of the annulus seal assembly to the outer body;

rotating the inner mandrel and connected outer body and upper locking mandrel to move an upper seal body of the annulus seal assembly axially upward, wherein as the upper seal body moves axially upward along threads between the upper seal body and a lower seal body of the annulus seal assembly, a portion of the upper seal body pushes the external locking device axially upward; and applying a second pressure above the running tool to preload the casing hanger into the wellhead.

6. The method of claim 5, wherein engaging the second anti-rotation device comprises extending a spring loaded pin from the outer body into internal stop rings connected to the inner mandrel to attach the outer body to the inner mandrel.

7. The method of claim 5, wherein the running tool further comprises a set of stop rings held together with shear pins and located between the inner mandrel and the outer body, the method further comprising, after engaging the third anti-rotation device, rotating the inner mandrel until the shear pins shear.

8. The method of claim 1, further comprising axially moving a piston of the running tool downward to land the annulus seal assembly onto the casing hanger.

9. A method, comprising:

locking down and preloading a casing hanger in a wellhead in a single trip, wherein the single trip comprises:

sending a running tool having an annulus seal assembly and casing hanger attached thereto into to the wellhead;

rotating the running tool a first time to drop the annulus seal assembly on the casing hanger;

applying a first pressure axially above the running tool to set the annulus seal assembly;

rotating the running tool a second time to close a gap between the annulus seal assembly and the wellhead; and applying a second pressure axially above the annulus seal assembly to preload the casing hanger.

10. The method of claim 9, wherein the first pressure and the second pressure are applied with a blowout preventer positioned above the wellhead.

11. The method of claim 9, further comprising pulling the running tool straight out of the wellhead, leaving the annulus seal assembly and the casing hanger installed and preloaded in the wellhead.

12. The method of claim 9, further comprising sealing an annulus between the casing hanger and the wellhead with the annulus seal assembly.

13. The method of claim 12, further comprising forming a first metal-to-metal seal between the annulus seal assembly and the casing hanger.

14. The method of claim 13, further comprising forming a second metal-to-metal seal between the annulus seal assembly and the wellhead.

15. The method of claim 9, wherein the setting of the annulus seal assembly comprises extending outwardly an external locking device into an internal groove of the wellhead.

16. The method of claim 9, wherein the gap is formed between the annulus seal assembly and the casing hanger after dropping the annulus seal assembly on the casing hanger to allow for tolerances and debris while landing and cementing the casing hanger.

17. The method of claim 9, further comprising engaging and disengaging a plurality of anti-rotation devices within the running tool to allow and prevent relative rotation between components of the running tool and the annulus seal assembly during rotating.

18. A tool assembly, comprising:

a running tool, comprising:

an outer body;

an inner mandrel positioned within the outer body;

an energizing mandrel slidably held between the inner mandrel and the outer body via a threaded connection between the inner mandrel and the energizing mandrel;

a first anti-rotation device positioned between the outer body and the energizing mandrel, wherein when the first anti-rotation device is engaged, the energizing mandrel and the outer body are connected together, and wherein when the first anti-rotation device is disengaged, the outer body is independently rotatable with respect to the energizing mandrel; and a second anti-rotation device positioned between the inner mandrel and the outer body, wherein when the second anti-rotation device is engaged, the second anti-rotation device connects the inner mandrel to the outer body, and when the second anti-rotation device is disengaged, the inner mandrel is independently rotatable relative to the outer body;

a casing hanger operationally coupled to the running tool; and an annulus seal assembly operationally coupled to the running tool above the casing hanger, wherein the annulus seal assembly comprises:

a lower seal body coupled to an upper seal body via threads;

a sealing element coupled to the lower seal body; and an external locking device positioned around an outer surface of the annulus seal assembly and axially between the upper seal body and an upper locking mandrel;

wherein a third anti-rotation device is positioned between the outer body of the running tool and the upper locking mandrel of the annulus seal assembly, wherein when the third anti-rotation device is engaged, the outer body and the upper locking mandrel are connected, and when the third anti-rotation device is disengaged, the upper locking mandrel and outer body are independently rotatable from each other.

19. The assembly of claim 18, wherein the seal element comprises:

a first sealing surface of the seal element configured to seal against an upper end of the casing hanger; and a second sealing surface of the seal element configured to seal against the inner surface of the wellhead.

* * * * *